United States Patent [19]

Caron

[11] Patent Number: 4,461,461

[45] Date of Patent: Jul. 24, 1984

[54] NON-CORROSIVE SECURITY RAILING

[76] Inventor: Lee Caron, 1310 Noble, Longwood, Fla. 32750

[21] Appl. No.: 423,531

[22] Filed: Sep. 27, 1982

[51] Int. Cl.[3] ..... E04H 17/14

[52] U.S. Cl. ..... 256/19; 256/65; 256/59

[58] Field of Search ..... 256/19, 65, 66, 59, 256/72

[56] References Cited

U.S. PATENT DOCUMENTS

| | | | |
|---|---|---|---|
| 3,107,900 | 10/1963 | De Paolo | 256/65 |
| 3,957,250 | 5/1956 | Murphy | 256/19 |
| 4,053,140 | 10/1977 | Clemens | 256/19 |
| 4,181,764 | 1/1980 | Totten | 256/19 X |

FOREIGN PATENT DOCUMENTS

| | | | |
|---|---|---|---|
| 2343877 | 10/1977 | France | 256/DIG. 5 |

*Primary Examiner*—Andrew V. Kundrat

[57] ABSTRACT

A security railing formed from polyvinyl chloride pipe which is lightweight, low cost, and non-corrosive. The top railing and the posts of the security railing are formed by laminating a first pipe and a second pipe, the second pipe having an outside diameter essentially equal to the inside diameter of the first pipe. The laminated railing is utilized for posts and the top railing of the security railing. A lower railing utilizes a polyvinyl chloride pipe having the same outside diameter as the laminated top railing. T connectors and cross connectors are used at the joints between the upper and lower railings and the posts. A plurality of holes in the lower surface of the upper railing and the upper surface of the lower railing permit the insertion of small diameter polyvinyl chloride pipe sections at closely spaced intervals to provide vertical railing elements. The security railing meets requirements of national building codes and will not permanently deform from loads.

9 Claims, 4 Drawing Figures

NON-CORROSIVE SECURITY RAILING

BACKGROUND OF THE INVENTION

1. Field of the Invention

The present invention relates to security railings for balconies, stairs, and the like and more particularly to a plastic railing which will meet building codes.

2. Description of the Prior Art

With the present trend toward multistory condominium and apartment buildings having balconies, there is a need for a security railing formed from non-corrosive materials. It has been found that metallic security railings which have been constructed from iron, steel, aluminum or the like have a short life in buildings exposed to polluted air and for buildings in coastal areas exposed to the corrosive effect of the salt water atmosphere. To maintain such metallic security railings in safe condition, continuous maintenance is required for removing rust and corrosion, and for refinishing of the railings. Where such maintenance is neglected, such railings can quickly become unsafe and dangerous.

There have been attempts in the prior art to develop reinforced non-metallic structures suitable for railings. For example, in U.S. Pat. No. 4,181,764 to Totten, a rail is disclosed having a wooden core with a weather and abrasion resistant outer coating. However, a plurality of valve means must be provided for releasing vapor from the core yet preventing passage of water into the core. Furthermore, the strength of the Totten rail is determined by the wood core. To obtain the necessary strength for a building security railing, it is considered that the resulting structure would be too bulky and unattractive. Murphy in U.S. Pat. No. 3,957,250 teaches a fence post fabricated from tubular plastic material and filled with semi-rigid or rigid foam for additional strength. However, the posts appears to be suitable only for stringing of wire fencing. The U.S. Pat. No. 4,053,140 to Clemens, et al shows a non-corrosive plastic handrail system designed for use in industrial applications along stairways, platforms, and the like to eliminate the corrosion problems due to electric currents and fields as well as corrosive environments. The strength of the handrail system described depends upon the use of a special thermosetting resin in which high tensile strength reinforcing fibers have been incorporated as taught by U.S. Pat. No. 3,859,409. Such specialized material is expensive and the patent does not disclose any testing of strength to determine if the material would satisfy building codes for balcony railings in apartment buildings and the like.

SUMMARY OF THE INVENTION

The present invention is a security railing formed entirely from polyvinyl chloride pipe having a novel laminated structure which has the advantages of being lightweight, low cost, and non-corrosive. Furthermore, the railing in accordance with the invention will withstand significant deformation yet will return to its original shape when the load is removed.

A balcony railing or the like is constructed in accordance with the invention having a relatively normal appearance. For example, there will be a plurality of upright posts which may be attached to the building floor in any conventional manner such as by flanges, anchoring in the concrete, or the like. It is preferred to anchor a steel pipe or bar into a concrete deck with the post placed over the pipe. A top rail is provided coupled to the vertical posts by suitable T or cross couplings. Similarly, a lower rail is provided coupled to the vertical posts by cross coupling. Disposed between the upper and lower posts is a plurality of smaller rail elements closely spaced in a conventional pattern.

In accordance with the invention, the top rail sections and the vertical posts are formed by laminating two polyvinyl chloride (PVC) pipes. For example, the outside pipe may be a schedule 40 PVC pipe having a nominal 1½ inch diameter which is actually 1.99 outside diameter and 1.66 inside diameter. An inner PVC pipe formed from schedule 80 PVC is inserted through the outer pipe. The outer diameter of the inside pipe is 1.66 inches and the inside diameter 1.278 inches. As may be recognized, the inside pipe forms a snug fit into the outside pipe to thereby form a laminated rail having both strength and flexibility. It may be seen that a load placed on the laminated rail will cause a deflection and the inner pipe may move relative to the outer pipe to prevent excessive stress at the point of load, yet the combination provides the required strength.

Advantageously, the rails in accordance with the invention are joined at points having T or cross fittings as will be described in more detail below. Where a joint between top rails is required, the inside pipe is offset on the order of 1 foot such that the joint of an inner tube or pipe is displaced from the joint of the outer pipe to minimize loss of strength at a joint.

In addition to the laminated construction of the top rail, similar laminated PVC pipes are utilized for the posts. It has been found that the lower rail does not require lamination although it will be obvious that laminated rail may also be used as the lower rail. Otherwise, schedule 40 1½ inch PVC pipe may be used.

The vertical elements between the posts may be ½ inch diameter schedule 80 PVC pipes spaced about 6 inches and installed in holes drilled along the top and bottom railing. It has been found that a spacing of posts of about 4 feet provides the required strength.

The PVC pipe utilized to form the rails of the invention may be obtained in a variety of finishes and colors. Thus, the security railing of the invention can be made very attractive and requires essentially no maintenance.

A typical railing section in accordance with the invention was tested under Southern Building Code, Section 1204, Special Load 1204.2-Railing. The railing was anchored in concrete in a horizontal position. The railing was loaded to 50 pounds per linear foot and withstood the load with a maximum downward deflection of 6 inches. After removing the load, the railing assumed its original shape with no permanent deformation. The testing laboratory reported that the security railing met the applicable code specifications.

The strength and safety features of the railing of the invention is further shown by a report from the testing laboratory which noted that during the 50 pound per linear foot load test, the anchoring of the jig used failed. This caused a 1600 pound load to be catapulted unto the railing. The laboratory reported that the railing received the entire weight of this load along the full length of the rail about the midsection thereof. This excessive load bent the rail at approximately a 45° but with no structural damage thereto. Once the load was removed, the railing sprung back to its original shape.

It is therefore a primary object of the invention to provide a security railing for balconies and the like which is low cost, non-corrosive, and will meet established building codes.

It is another object of the invention to provide a security railing formed from polyvinyl chloride plastic in which the main members thereof are formed from laminated PVC pipe.

It is yet another object of the invention to provide a plastic pipe security railing which requires little maintenance and which can withstand loads specified by building codes.

It is still another object of the invention to provide a PVC security railing which may be fabricated in a variety of colors.

It is a further object of the invention to provide rails for a security railing formed from tubular PVC pipe having an outer pipe of schedule 40 PVC and a snug fitting inner pipe of schedule 80 PVC.

These and other objects and advantages of the invention will become apparent from the following detailed description when read in conjunction with the drawings.

DETAILED DESCRIPTION OF THE PREFERRED EMBODIMENT

Figure 1:
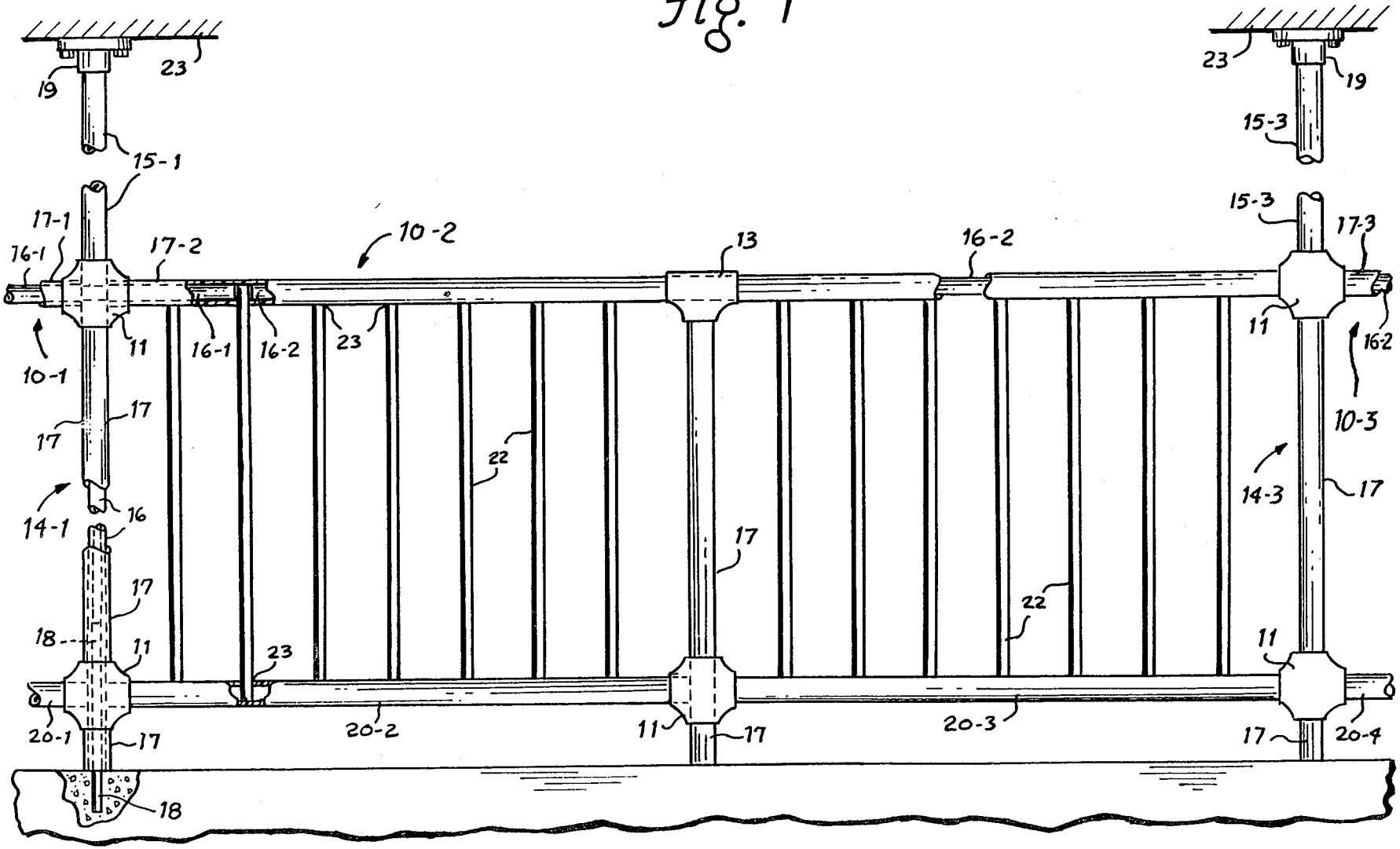
FIG. 1 is an elevation view of a typical security railing in accordance with the invention showing details of the construction thereof.
Figure 3:
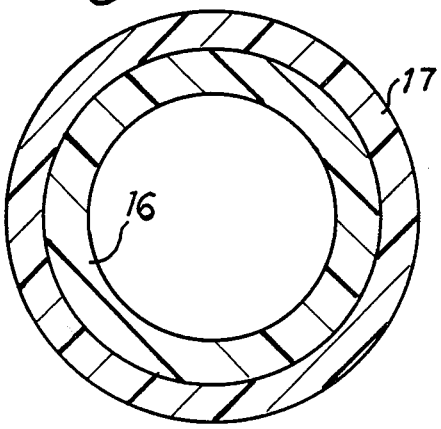
FIG. 3 is a cross sectional view of a laminated railing of the invention.

Referring first to FIG. 1, a typical arrangement for a security railing in accordance with the invention is shown. For purposes of illustration, the security railing is assumed to be installed on a concrete deck 19 which could be a balcony, porch, patio, or the like. Two sections of the security rail are shown and it is assumed that the railing continues to the left and right. Three posts 14, identified as 14-1,14-2, and 14-3, are shown. Each post 14 is formed from an outer pipe 17 formed from polyvinyl chloride (PVC) plastic. An inner pipe 16 fits snugly within outer pipe 17 as shown in cross sectional view in FIG. 3. Outer pipe 17 is formed from schedule 40 PVC pipe and inner pipe 16 is formed from schedule 80 PVC pipe. Pipe 16 forms a snug fit with outer pipe 17 such that bending of a railing element such as 14-1 will permit slight movement between inner pipe 16 and outer pipe 17 to thereby prevent buildup of stresses.

Figure 2:
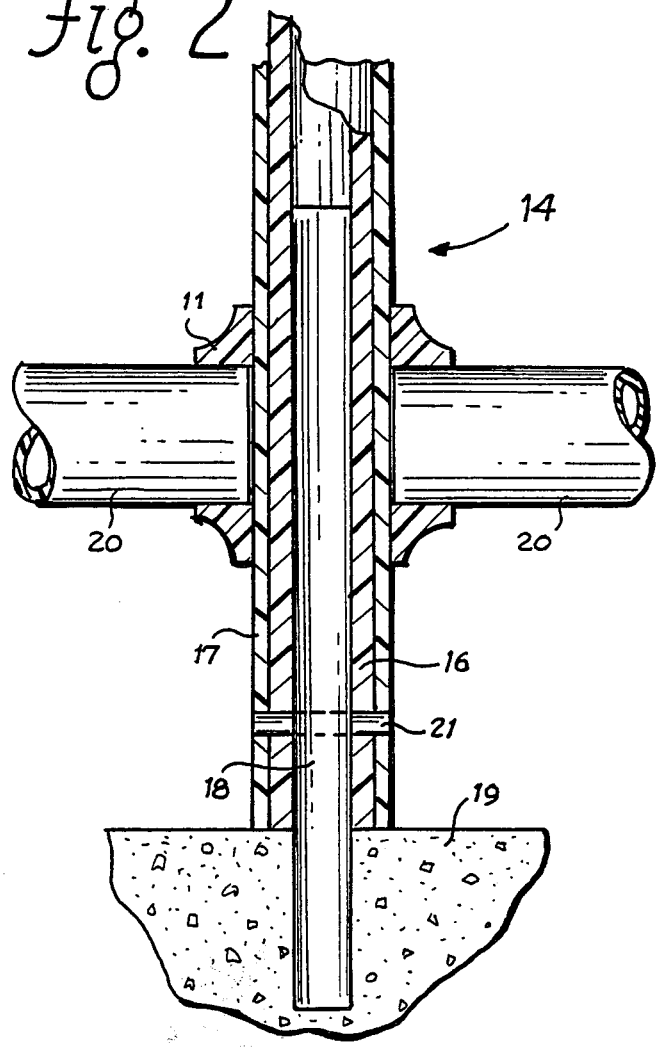
FIG. 2 is a cross sectional detail of a preferred method of attaching the security railing to a deck.

A steel pipe or bar 18 is disposed in concrete slab 19 projecting up about 1 to 1½ feet above slab 19. The outer diameter of bar 18 is selected to form a tight fit in the inside diameter of inner pipe 16. Thus, when post 14-1 is installed it is tapped or driven down over bar 18 until the lower end is flush with slab 19. As indicated in FIG. 2, post 14-1 and bar 18 can be drilled to accept a PVC pin 21 for additional security. A cross fitting 11 is placed over post 14-1 at the distance desired for lower rail 20 above slab 19. The outer posts 14-1 and 14-3 in the railing are similarly formed and installed.

The lower rail 20 for the railing sections shown may be formed from schedule 40 PVC pipe having the same size as pipe 17 used with posts 14. A series of holes 23 are provided along the upper side of a typical lower rail section 20-2 which is of length to span from post 14-1 to post 14-2. The ends of lower rail sections 20 butt against post 14 as seen in FIG. 2. Holes 23 accept vertical railing elements 22 which are preferably formed from ½ inch diameter schedule 80 PVC pipe. The spacing from center to center of railing elements 22 may be 6 inches.

Top railings 10 are fabricated in the same manner as posts 14 except to provide for coupling of adjacent railings. For example, in FIG. 1, top railing 10-2 may be about 8 feet in length spanning from post 14-1 to 14-3. As may be seen from the dashed lines, railing 10-2 has its outer PVC pipe 17 butting against outer pipe 17 of post 14-1 in cross fitting 11. Similarly, the right end of outer pipe 17 of rail railing 10-2 butts against outer pipe 17 of post 14-3. Inner pipe 16 in rail 10-2, however, starts at the second vertical railing element 22 to the left of post 14-1 and projects about 1 foot through post 14-3 as shown. Similarly, inner pipe 16-1 of railing 10-1 extends through post 14-1 and T fitting 11 into outer pipe 17 of rail 10-2 as shown. Advantageously, the overlap of the inner pipe 16 with the outer pipes 17 of adjacent railing sections 10 provides additional strength and rigidity in concert with T fittings 11 which are cemented to the posts 14 and the railing sections 10. It may be noted that a T section 13 is provided at the upper end of post 14-2 since railing 10-2 extends from post 14-1 to 14-3. The underside of railing 10-2 includes holes 23 to accept the upper ends of vertical railing elements 22.

Also shown in FIG. 1 are optional auxiliary supports 15-1 and 15-3. When a security railing in accordance with the invention is to be installed on a balcony or porch having an overhead ceiling, cross connections 11 may be provided at the top of alternate post such as 14-1 and 14-3. Auxiliary posts 15-1 formed from schedule 40 PVC pipe of the same type used for pipe 17 may be cemented into cross connections 11 and to mounting flanges 19 which are fastened to ceiling or beam 23. Posts 15-1 may be extensions of the outer pipe 17 of post 14-1. Where optional support posts 15 are not required, the cross connections 11 would be replaced with T's 13.

Although not shown, the end of a security railing section may be finished with a right angle connector (not shown) rather than a T13. Other configurations such as right angle railing sections and alternative end sections using readily available PVC pipe fittings will be obvious to those of skill in the art.

Calculations have been made for the configuration of the invention illustrated in FIG. 1. It was assumed a worst case of no vertical railing element 22 and a load of 50 pounds per foot concentrated into a single force of 200 pounds applied horizontally at the mid-center of between vertical posts 14-1 and 14-2 on top rail 10-2 for an application in which auxiliary supports 15-1 and 15-3 are not used. For the top rail section 10-2 having outside PVC pipe 17 of 1.99 inches in diameter and 1.66 inches inside diameter with inside pipe 16-2 having an inside diameter of 1.278, the stress in top rail section 10-2 would be approximately 8,955 pounds per square inch. The PVC manufacturer's data shows a flexural strength of 11,000 pounds per square inch for the laminated rail section 10-2. As discussed hereinabove, actual tests by a testing laboratory have verified these calculations.

The PVC pipe utilized in the preferred embodiment of the invention is readily available at low cost as compared to metallic structures providing the same strength. It is available with a high gloss or a satin type finish, and the material may be pigmented in a variety of colors to suit the building with which the railing may be used. The polyvinyl chloride material is impervious to corrosive atmospheres, salt spray, and other environmental conditions which will quickly damage metal railings. No painting is required and the material is easily cleaned. An embodiment of the invention has been described in which round, hollow PVC pipes have been utilized. However, PVC may be extruded in square and rectangular shapes as well and such shapes are suitable for practicing the invention.

Figure 4:
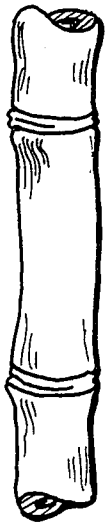
FIG. 4 is an alternative decoration surface for the railings.

Additionally, the outer pipes may be molded to decorative shapes, such as bamboo or the like as shown in FIG. 4. Although a specific design has been disclosed appropriate to the pipe sizes selected, it will be apparent that greater strength may be provided by use of larger and thicker pipe sections, closer spaced posts, and other modifications and variations which will be obvious to those of skill in the art. Such modifications are to be considered within the spirit and scope of the invention.

I claim:

1. A security railing comprising:

a plurality of railing sections, each of said sections formed from a first polyvinyl chloride pipe and a second polyvinyl chloride pipe, said second pipe having an outside dimension essentially equal to the inside dimension of said first pipe, said second pipe inserted into said first pipe;

a plurality of posts, each formed from one of said railing sections;

a plurality of horizontal top rails, each formed from one of said railing sections;

a joint between adjacent ones of said top rails formed by extension of said second pipe beyond the end of one of said top rails, said extended second pipe inserted into an end of the adjacent one of said top rails and contacting said second pipe in said adjacent one of said top rails;

a T connector joint disposed at the top end of at least one of said posts for connecting an end of one of said top rails to said one of said posts, said top rail end cemented in said T connector;

a lower rail cross connector disposed near the lower end of each of said posts, said cross connectors cemented to said posts;

a plurality of horizontal lower rails formed from polyvinyl chloride pipe, one of said lower rails disposed between each adjacent pair of said posts, said lower rail connected to said post by said cross connector, said lower rails cemented to said cross connectors; and a plurality of vertical rail members formed from polyvinyl chloride pipe having a dimension less than the inside dimension of said second pipe, said horizontal top rails having a plurality of holes through the lower surface thereof and said horizontal lower rails having a plurality of holes through the upper surface thereof, said holes complementary to said holes in said top rails, one of said vertical rail members inserted into each pair of said complementary holes.

2. The security railing defined in claim 1 which further comprises:

a plurality of metal rods vertically attached to the floor of a structure utilizing said security railing, said rods having a diameter to form a snug fit in said second pipe of each of said posts, whereby the installed security railing has each of said posts disposed over one of said rods.

3. The security railing as defined in claim 2 which further comprises:

said posts and said rods include a hole for a pin therethrough; and a pin inserted into said pinhole.

4. The security railing as defined in claim 2 which further includes at least one of said posts having a cross connector joint disposed at the top end thereof and cemented to said post, said cross connector joint having a vertical polyvinyl chloride pipe inserted in the top opening thereof and cemented thereto, the upper end of said vertical pipe attached to the ceiling portion of said structure.

5. The security railing as defined in claim 1 in which:

said first pipe is formed from schedule 40 polyvinyl chloride plastic; and said second pipe is formed from schedule 80 polyvinyl chloride plastic.

6. The security railing as defined in claim 1 in which said lower rails are formed from said railing sections.

7. The security railing as defined in claim 1 in which said first and second pipes and said vertical rail members are round.

8. The security railing as defined in claim 1 in which said first and second pipes are rectangular.

9. The security railing as defined in claim 1 in which the outside surfaces of said top rails, said posts, and said bottom rails are molded in a decorative pattern.

* * * * *